United States Patent [19]

Orgebin et al.

[11] Patent Number: 5,069,777

[45] Date of Patent: Dec. 3, 1991

[54] PROCEDURE FOR THE FIXED-BED SWEETENING OF PETROLEUM FRACTIONS

[75] Inventors: Jean-Michel Orgebin, Saint-Adresse; Claude Marty, Le Havre; Patrick Ansquer, Lillebonne; Pierre Maroy, Versailles, all of France

[73] Assignee: Compagnie de Raffinage et de Distribution Total France, Levallois-Perret, France

[21] Appl. No.: 579,820

[22] Filed: Sep. 10, 1990

[30] Foreign Application Priority Data

Sep. 8, 1990 [FR] France ..... 89 11781

[51] Int. Cl.[5] ..... C10G 27/10; C10G 29/00

[52] U.S. Cl. ..... 208/207; 208/189

[58] Field of Search ..... 208/189, 207

[56] References Cited

U.S. PATENT DOCUMENTS

| | | | |
|---|---|---|---|
| 3,230,180 | 1/1966 | Larson | 252/431 |
| 3,686,094 | 8/1972 | Laleuf | 208/206 |
| 4,124,531 | 11/1978 | Frame | 208/207 |
| 4,207,173 | 6/1980 | Stanoky, Jr. | 208/207 |
| 4,248,694 | 2/1981 | Carlson | 208/207 |
| 4,290,917 | 9/1981 | Carlson | 208/207 |
| 4,298,463 | 11/1981 | Frame | 208/207 |
| 4,498,977 | 2/1985 | Frame | 208/207 |
| 4,498,978 | 2/1985 | Frame | 208/207 |
| 4,502,949 | 3/1985 | Frame et al. | 208/207 |
| 4,574,121 | 3/1986 | Frame | 208/207 |
| 4,753,722 | 6/1988 | Le et al. | 208/207 |
| 4,913,802 | 4/1990 | Bricker et al. | 208/207 |

*Primary Examiner*—Helane E. Myers

*Attorney, Agent, or Firm*—A. Thomas S. Safford

[57] ABSTRACT

The invention relates to a process for the sweetening of a petroleum fraction in a fixed catalytic bed in the presence of an oxidizing agent, by catalytic oxidation of the mercaptans which it contains, in the presence of a catalyst in the form of a support impregnated with a metal chelate and in the absence of an aqueous base, the water content of the support is maintained within a predetermined range of values by action on the solvent power of the feedstock for the water of the support as a function of temperature.

30 Claims, 1 Drawing Sheet

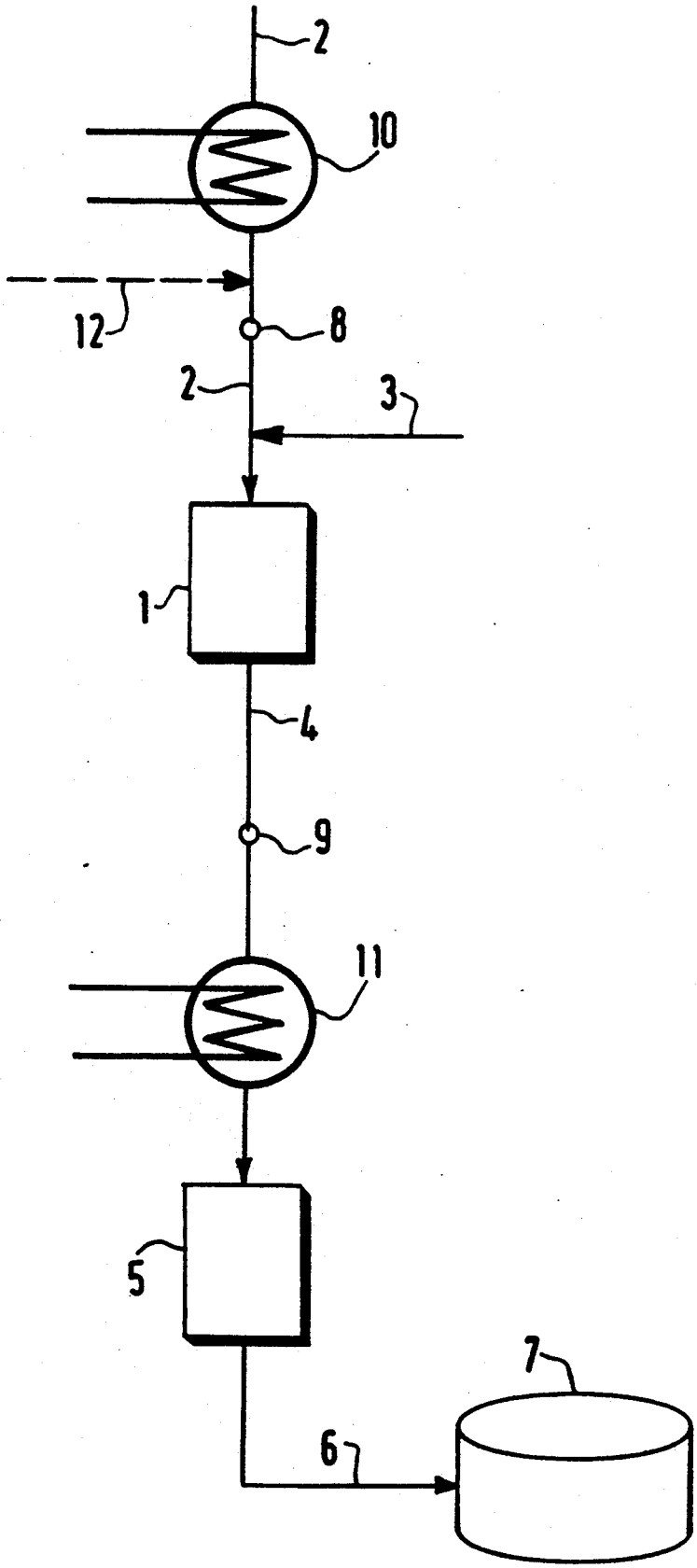
2
10
12
8
2
3
1
4
9
11
5
7
6

PROCEDURE FOR THE FIXED-BED SWEETENING OF PETROLEUM FRACTIONS

The present invention relates to the fixed-bed sweetening of petroleum fractions by catalytic oxidation to disulfides of the mercaptans which they contain.

In principle, such oxidation can be achieved simply by mixing the petroleum fraction to be treated and an aqueous solution of an alkaline base, to which a catalyst based on a metal chelate is added, in the presence of an oxidizing agent. The petroleum fraction and the aqueous solution of the alkaline base are not miscible, and it is at the interface of the two liquid phases that the mercaptans are converted to disulfides. (See French patent 1,249,134.)

With mercaptans which are more difficult to oxidize, it is preferable to treat the petroleum fraction with a supported catalyst in the presence of an alkaline base and of an oxidizing agent, this process being called a "fixed-bed sweetening process". The oxidizing agent, usually air, is mixed with the fraction to be sweetened. The alkaline base, generally an aqueous soda solution, is introduced into the reaction medium either continuously or intermittently to maintain the alkaline conditions and the aqueous phase necessary for the oxidation reaction. The metal chelate used as catalyst is generally a metal phthalocyanine. (See French patent 1,301,844 or its equivalent U.S. Pat. No. 2,988,500.) The reaction is carried out at a pressure which generally ranges from 5 to $30 \cdot 10^5$ Pascals and at a temperature between 20° and 40° C. However, as is well known to those skilled in the art, when such a reaction is run in an oxidizing environment with aqueous soda (or a strong base) but at a temperature higher than ambient temperature, the stability of a catalyst based on a metal chelate decreases rapidly to the detriment of the sweetening reaction.

Moreover, it is advisable to replace the spent soda solution, not only because of the impurities from the feedstock, which dissolve in the solution and render it unfit for recycling, but also because of the variation of the concentration of the base, which decreases as a result of the water from the feedstock and from the conversion of the mercaptans to disulfides.

To overcome this drawback, it has been proposed to dispense with the use of aqueous soda (or an aqueous base). [See French patent 2,343,043 (based on U.S. application Ser. No. 663,879 issued as a continuation-in-part as U.S. Pat. No. 4,207,173) and U.S. Pat. Nos. 4,498,978 and 4,502,949.] However, in order that the reaction may proceed normally, the active sites of the support should then be in contact with the mercaptans present in the petroleum feedstock, which implies a homogeneous medium, and hence the absence of an aqueous solution. Now it seems that the water molecules already present in the feedstock, and especially those produced during the reaction, promote the appearance on the catalyst surface of such an aqueous solution, which When maintained above a certain threshold will result in a lowering of the catalytic activity. It has therefore been proposed to either incorporate a solid desiccant in the support (U.S. Pat. No. 4,498,978) or reabsorb this aqueous phase periodically by drying the catalyst by means of a water-miscible polar solvent such as an alcohol (French patent application 88/16,907 and its equivalent U.S. application Ser. No. 07/454,712). However, when they do prove effective, these solutions necessarily result in relatively high operating costs.

The present invention seeks to overcome all of these drawbacks by proposing a process for the sweetening of a petroleum fraction by catalytic oxidation of the mercaptans which requires neither the use of an anhydrous inorganic or organic base or of a desiccant in admixture with the support, nor periodic drying of the support by means of a solvent.

The applicants have discovered that when the oxidation reaction of the mercaptans is able to proceed in the absence of a basic solution, it becomes possible to run this reaction without damage to the catalyst at a higher temperature than in the prior art, that is, at a temperature which generally is above 40° C. This effect on the temperature, which may be continuous or momentary, results in a modification of the solubility of the water in the feedstock and, consequently, in a change in the amount of water present on the surface of the catalyst support. It is then possible to maintain the catalytic properties at their optimum level.

The present invention has as a preferred embodiment a process for the sweetening of a petroleum fraction in the presence of an oxidizing agent, by catalytic oxidation of the mercaptans which it contains, in the presence of a support in a fixed bed impregnated with a metal chelate and in the absence of an aqueous base, this process being characterized in that the water content of the support is maintained within a predetermined range of values by action on the solvent power of the feedstock for the water of the support as a function of temperature, and in that the temperature of the feedstock is set at a value that is sufficient for solubilizing the water of reaction from the conversion of the mercaptans to disulfides.

Thus the temperature of the feedstock is chosen so as to maintain the water content of the support at between 0.1and 50, and preferably between 1 and 25, percent by weight of the support.

This predetermined range of values of water of the support will, of course, depend on the actual nature of the catalyst support used during the sweetening reaction. In fact, the applicants have found that while there are many catalyst supports that can be used without aqueous soda (or without an aqueous base), their activity manifests itself only when their water content (also known as their hydration rate) is maintained within a relatively narrow range of values that varies with the support but is apparently related to the silicate content of the support and to its pore structure.

Thus, with catalyst supports of the type described in European patent application 252,853 (see equivalent U.S. Pat. No. 4,794,097), good conversion of the mercaptans to disulfides is achieved without an aqueous base and without an aqueous solution when the hydration rate of the support is within the range from 1 to about 11 percent by weight. (Below 1 percent, the support is too dry, and above 11 percent an aqueous phase appears on the support.)

With other supports of the basic aluminosilicates type, a broadening or, conversely, a narrowing of this range may be observed, depending on the type of catalyst. This seems to have been observed also with supports based on activated charcoal. (See U.S. Pat. No. 4,498,978.) It would appear, however, that the range of hydration-rate values of a support based on activated charcoal is too narrow for industrial use.

Once the optimum value of the hydration rate of the support has been determined by experimentation, the initial water content of the support can be adjusted to that value by means known in the art, as follows:

To reduce the initial hydration rate of the support, the temperature of the feedstock in the reactor may be increased, or a quantity of water-miscible polar solvent may be injected, continuously or intermittently, or a hot fluid such as air may be circulated in the reactor, for example.

Conversely, to increase that rate, the temperature of the reactor may be lowered, or a given quantity of water may be routed to it.

In the course of their work on the sweetening of mercaptans in the absence of any aqueous base and any aqueous solution, the applicants have now established that once the desired hydration rate of the catalyst support has been obtained in the catalyst bed, that rate can be maintained substantially constant during the sweetening reaction, notwithstanding the water supplied by the feedstock, whether normally or accidentally, especially when the sweetening unit is located downstream of a prewash unit; and notwithstanding the appearance of water of reaction. (Two mercaptan molecules give rise to the formation of one disulfide molecule and one water molecule).

In fact, despite the poor affinity of water for hydrocarbons, the hydration rate of the support can be reduced simply by increasing the temperature of the feedstock in the sweetening reactor, notwithstanding the apparent affinity of the support for the water molecules. Moreover, when the quantities of water from the reaction are substantial, the hydration of the support can be maintained at a given value by adjusting the reaction temperature to levels which heretofore have been regarded as impractical because of the instability of the catalyst at these temperatures in the presence of an aqueous base. Thus, when the water content of the support becomes too high, the temperature of the feedstock is raised until the water content again reaches the desired value, and, conversely, when the water content of the support tends to drop below that value, the temperature of the feedstock is lowered accordingly.

The petroleum fraction will generally be held at a temperature above 30° C. and preferably between 40° and 140° C. The necessary heat may be supplied by any means of a type known per se but is preferably supplied by heat exchange upstream of the reaction zone.

When the petroleum feedstock to be treated is, for example, a fraction containing from 20 to 300 ppm of mercaptans and less than 150 ppm of water soluble in the feedstock to be treated, the catalytic oxidation reaction is advantageously run at a temperature above 30° C. and preferably between 40° and 120° C. These conditions apply in particular to the sweetening of petroleum fractions such as the so-called catalytic or straight-run kerosenes or gasolines.

Similarly, when the petroleum feedstock to be treated is, for example, a fraction containing from 300 to 3,000 ppm of mercaptans and more than 100 ppm of soluble water, the catalytic oxidation reaction is run at a temperature above 40° C. and preferably between 50° and 140° C. These conditions apply particularly to the sweetening of petroleum fractions such as the light gasolines.

In these two cases, the optimum hydration rate of the support on which the catalytic activity depends is maintained at a given value, generally between 1 and 25 percent by weight, notwithstanding possible variations in the feedstock, by letting the temperature fluctuate by a few degrees about an equilibrium temperature, depending on whether the support tends to become hydrated or dehydrated.

Said rate may also be maintained by increasing the reaction temperature substantially and injecting a certain quantity of water, which may vary as a function of the water and mercaptan content of the feedstock.

In accordance with a particularly advantageous embodiment of the process of the invention, water may therefore be injected into the petroleum fraction upstream of the reaction zone for easier adjustment of the water content of the support within the predetermined range of water contents.

As a possible alternative, the reaction might be carried out at a temperature a few degrees below the aforesaid equilibrium temperature, for example, a given quantity of low-hydrated feedstock being introduced periodically or continuously at a higher temperature.

To adjust the temperature of the oxidation reaction of the mercaptans, means are used which permit measurement of the water content of the feedstock and of the effluent, or of the catalyst support, as well as of the mercaptan content of the feedstock and of the effluent.

Among the means which may be used to measure the water content of the support are systems permitting the taking of samples of the catalyst support without shutting down the unit, in a manner known per se. On the basis of these samples, the hydration rate of the support can readily be measured by the method of Karl Fischer and then be restored to its optimum value by regulation of the temperature in conformity with the present invention. A sensor system placed directly into the interior of the catalyst bed may also be used.

Among the means which may be used to measure the mercaptan content of the feedstock, both at the inlet of the reactor and at its outlet, are chromatographic analyzers of a type known per se. In place thereof, samples may be taken periodically for analysis by a method such as the so-called silver nitrate method.

Another means that is easy to adopt consists in the use of two sensors for the continuous measurement of the water content of the feedstock, the first located upstream of the catalyst bed, the second downstream of it. The sensors which can be used for the continuous measurement of the water content of the feedstock include commercial sensors, such as those marketed by Endress Hauser, and capacitive sensors of the type described in French patent application 2,512,958. The difference between the water content measured downstream and that measured upstream then readily makes it possible to determine how much the water content of the support has increased or decreased, allowing for the quantity of mercaptans converted to disulfides. The water content of the catalyst support in the reactor can then be held substantially constant by adjusting the reaction temperature (or the quantity of additional water injected).

A first advantage of the present invention stems from the very principle of the reaction, which is related to the absence of a base or caustic solution in the feedstock and in the effluents: On the one hand, it is no longer necessary to separate the bases or to reprocess them, or to have at one's disposal a unit for their destruction; on the other hand, the absence of a base, even in trace amounts, in the petroleum feedstocks treated makes the latter excellent products for direct further use.

A second advantage of the present invention is due to the fact that the water of reaction is swept along by the petroleum feedstock itself during the sweetening. Thus there is no longer any need for costly drying of the support by injection of solvents into the feedstock or by the use of a desiccant in the catalyst bed.

A third advantage of the present invention stems from the fact that the sweetening reaction is run at a higher temperature than in the prior art. Therefore the reaction kinetics are improved and it becomes possible to carry out the reaction continuously at a higher hourly space velocity than in the prior art. The hourly space velocity may be on the order of from 1 to 8 v/v/hr (volume of feedstock per volume of catalyst and per hour) for feedstocks of the kerosene type and on the order of from 1 to 10 v/v/hr for feedstocks of the gasoline type. This results in substantial savings in construction costs for the sweetening unit since it can then be of smaller size. Finally, with the reaction kinetics improved, it becomes also possible to treat the more stubborn or heavier feedstocks which are difficult to sweeten by prior-art methods, or to perform the sweetening of the mercaptans continuously where heretofore only batch methods could be employed.

A fourth advantage of the present invention is based on the fact that the sweetening reaction is carried out in a homogeneous phase, without formation of gums, which means lower washing and maintenance costs and simpler equipment downstream of the unit.

The process of the invention is well suited for the sweetening of all petroleum fractions and, in particular, the sweetening of gasolines and kerosenes. These petroleum fractions actually contain very little water (generally less than 500 ppm), and the increase in temperature necessary for solubilizing the water molecules produced in situ during the sweetening reaction consequently is held within acceptable limits.

Moreover, when the petroleum fraction to be treated contains relatively substantial amounts of mercaptans, for example, more than 300 ppm, the formation in situ of a corresponding quantity of water molecules can be compensated for by first drying the feedstock on molecular sieves (or by cooling and then decanting it), for example, with a view to reducing its initial water content to a minimum.

Except for the absence of an aqueous base and for a temperature and hourly space velocity that are higher than in the prior art, the conditions of the sweetening reaction of petroleum feedstocks in accordance with the invention are the same overall as those described in the prior art. For example, these conditions may be as follows:

| | |
|---|---|
| Temperature: | 40 to 140° C. |
| Pressure: | $10^5$ to $30 \cdot 10^5$ Pascals |
| Quantity of oxidizing agent (air): | 1 to 3 ltr/kg of mercaptans |
| Hourly space velocity, v/v/h (volume of feedstock per volume of catalyst and per hour): | 1 to 10 |
| Water content of support, wt. % | 1 to 25 |

The supports suitable for use in accordance with the present invention include supports based on activated charcoal, alumina, clay, aluminosilicates, silicates, or mixtures thereof, which may be employed in a manner known per se.

As metal chelate, any chelate used for this purpose in the prior art, and in particular the metal phthalocyanines, porphyrins or corrins, may be deposited on the support. Particularly preferred are cobalt phthalocyanine and vanadium phthalocyanine. The metal phthalocyanine is preferably used in the form of a derivative. Particularly preferred are the commercially available sulfonates, such as the mono- or disulfonate of cobalt phthalocyanine, and mixtures thereof.

One embodiment of the invention will now be described in detail, by way of example but not of limitation, with reference to the single figure of the accompanying drawing.

This figure represents a flowsheet of an embodiment for the continuous operation of the process of the invention.

In this embodiment, the petroleum fraction to be sweetened is fed to the reactor 1 through a line 2 into which an oxidizing agent such as air, for example, is introduced directly through a line 3. The treated petroleum fraction is discharged through a line 4 which passes through a filter system 5 designed to eliminate the traces of water and of nascent sulfur often produced during the oxidation of the mercaptans and not retained by the support. The treated feedstock is then transferred through a line 6 to a storage tank 7.

In accordance with the invention, the measuring sensors 8 and 9, located upstream and downstream, respectively, of the reactor, permit the continuous determination of the water and mercaptan contents at the inlet and outlet of the reactor 1. It is thus possible to ascertain continuously whether the water content of the catalyst support is increasing or decreasing. Corrective action may then be taken by adjusting the quantity of heat supplied to the feedstock by a heat exchanger 10 inserted in line 2 upstream of the reactor 1. A portion of the heat supplied by the heat exchanger 10 can then be recovered from the water formed, and eliminated at 5, by means of a heat exchanger 11 located in line 4 downstream of the reactor 1.

If desired, water may be injected into the feedstock through a line 12, which here is located between the temperature regulating stage at 10 and the catalytic oxidation stage at 1 of the petroleum fraction. In this embodiment of the invention, the temperature of the feedstock at the outlet of the heat exchanger 10 will be slightly higher than that required to maintain the water content of the support at its desired value, and more water may be introduced, for example, through line 12 to restore the water content to the desired value notwithstanding the fluctuations of the water and mercaptan content or temperature of the feedstock.

The advantage of this embodiment of the invention is that regulation is easier to achieve by manipulating a quantity of water injected than by varying the feedstock temperature.

As will be apparent from the examples which follow, which are not limiting, the use of the invention is particularly effective in the sweetening of petroleum fractions, even those which are regarded as difficult to treat.

EXAMPLE 1

The catalyst support used in this example was prepared as described in European patent application 252,853. After impregnation of the support with a sulfonated cobalt phthalocyanine cyanine of the type marketed by Société Francaise Procatalyse under the trade name LCPS, this catalyst is in the form of granules with a specific surface of about 50 $m^2/g$, which contains in the main about 1.5 kg of chelate per $m^3$ of support. The support contains about 10 percent by weight of carbon, 20 percent by weight of silicon, and from 8 to 9 percent by weight of potassium in the form of insoluble salts.

Pilot studies of this catalyst support have shown that the optimum water content ranges from 1 to about 10 percent by weight. With a water content of less than 1 percent by weight, the catalyst becomes rapidly deactivated. Deactivation is very much slower above 1 percent and up to 10 or 11 percent by weight.

Two identical lots of catalyst, $L_1$ and $L_2$, were prepared and placed directly in a pilot reactor whose height-to-diameter ratio was about 5. Provision was then made for a good initial hydration rate of the catalyst (5 to 6 percent by weight of water) by passing over it at ambient temperature an equal volume of industrial ethanol at an hourly space velocity of 1 v/v/hr.

Two feedstocks, $C_1$ and $C_2$, were used.

$C_1$ was a feedstock of the kerosene type, resulting from the mixing of isthmus/cactus crudes and Maya crude and containing about 80 ppm of mercaptans and 100 ppm of water.

$C_2$ was a feedstock of the gasoline type which contained about 300 ppm of mercaptans and 150 ppm of water.

These feedstocks had the following characteristics:

| | $C_1$ | $C_2$ |
|---|---|---|
| Aromatic compounds, percent by volume | 20 | 60 |
| Olefins, percent by volume | <5 | 20 |
| Saturated hydrocarbons, percent by volume | 78 | 20 |
| Mercaptan content, ppm by volume | 80 | 300 |
| Water content at 40° C. ppm by weight | 100* | 150 |

*Since the feedstock here came from a prewash unit, this value represents the maximum solubility of the water in the feedstock at that temperature.

Air was used as oxidizing agent, and no aqueous basic solution was used. Feedstock $C_1$ was passed over the first lot, $L_1$, under the following operating conditions:

| | T1 | T2 | T3 | T4 |
|---|---|---|---|---|
| Reaction temperature, °C. | 40 | 80 | 45 | 80 |
| Pressure, pascals | $6 \cdot 10^5$ | $6 \cdot 10^5$ | $6 \cdot 10^5$ | $6 \cdot 10^5$ |
| Air feed, liters | 1.8 | 1.8 | 1.8 | 1.8 |
| Initial water content, ppm | 100 | 100 | 100 | 677 |
| Water content of effluents, ppm | 100 | 700 | 120 | 700 |
| Hourly space velocity, v/v/hr | 0.8 | 4 | 1 | 4 |
| Initial hydration rate, wt. % | 5 | 10 | 2 | 5 |
| Final hydration rate, wt. % | 10 | 2 | 5 | 7 |
| Duration of cycle, days | 90 | 1 | >300 | >300 |

During test T1, it was observed that the mercaptan content of feedstock $C_1$ being treated was less than 5 ppm for about the first 60 days. Then the mercaptan content of the effluents gradually increased and exceeded 10 ppm at the end of 90 days due to the gradual saturation of the catalyst support with water. It could then be readily ascertained that the water of reaction had been taken up by the support, whose hydration rate had increased to over 10 percent.

Test T2 was then conducted, the temperature of the feedstock being increased to 80° C. and the hourly space velocity to 4 v/v/hr. It was found that the mercaptan content of feedstock $C_1$ being treated was again less than 5 ppm during the first 6 days and then rose sharply, exceeding 10 ppm at the end of 7 days, this time as a result of the dehydration of the catalyst support, whose hydration rate had dropped below 1 percent.

The operating conditions were then changed for test T3 in conformity with the process of the invention. It was observed that the mercaptan content of feedstock $C_1$ being treated was still less than 5 ppm after 300 days of operation. The hydration rate of the support actually remained substantially constant because of the increase in temperature from 40° to 45° C., which made it possible to remove with the feedstock all water of reaction from the conversion of the mercaptans to disulfides.

The reaction conditions were then again changed to proceed with test T4, also in conformity with the process of the invention. Again it was found that the mercaptan content of feedstock $C_1$ being treated was always less than 5 ppm, even after 300 days of operation. The hydration rate of the support was actually maintained at a constant value of about 6 percent, despite the sharp increase in the temperature (from 45° to 80° C.) and in the hourly space velocity (from 1 to 4 v/v/hr), through the injection of water in a sufficient quantity (+577 ppm) so that the feedstock, notwithstanding its substantially increased solvent power at 80° C., was only able to dissolve in the reactor the quantity of water of reaction produced.

Another test was then run with feedstock $C_2$, a gasoline with a much higher water and especially mercaptan content. The operating conditions were as follows:

| | T5 | T6 |
|---|---|---|
| Reaction temperature, °C. | 40 | 70 |
| Pressure, pascals | $6 \cdot 10^5$ | $6 \cdot 10^5$ |
| Air feed, liters | 1.8 | 1.8 |
| Initial water content of feedstock, ppm | 150 | 815 |
| Water content of effluents, ppm | 150 | 900 |
| Hourly space velocity, v/v/hr | 0.8 | 5 |
| Initial hydration rate, wt. % | 5 | 11 |
| Final hydration rate, wt. % | 11 | 6 |
| Duration of cycle, days | 28 | >300 |

A test was first run on lot $L_2$ with feedstock $C_2$ under the conditions set forth under T5. It was found that at temperatures which differed little from those employed in the prior art, the quantity of water of reaction due to the relatively substantial quantity of mercaptans in gasoline $C_2$ made it necessary to terminate the test after 28 days.

The reaction conditions were then changed to those set forth under T6. It was found that as with the kerosene feedstocks, the process of the invention permits the mercaptan content to be constantly maintained below 10 ppm by action on the solvent power of the feedstock as a function of temperature analogous to test T4 described earlier.

What is claimed is:

1. A process for sweetening a petroleum fraction by catalytic oxidation of mercaptans contained therein, comprising contacting said fraction with an oxidizing agent in the presence of a fixed bed of a catalyst formed of a support impregnated with a metal chelate and in the absence of any aqueous base, maintaining the water content of the support within a range of values within which the catalyst remains effective to convert mercaptans to disulfide by manipulating the net effective water solvency power of the feedstock and regulating the temperature of the feedstock to be sufficiently high to solubilize the water of reaction resulting from the conversion of the mercaptans to disulfides.

2. A process as defined in claim 1, wherein the heat necessary for bringing the feedstock to the desired temperature for solubilizing the water of reaction is supplied by heat exchange upstream of the reaction zone.

3. A process as defined in claim 1, wherein the temperature of the feedstock is chosen so as to maintain the water content of the support at between 0.1 and 50 percent by weight of the support.

4. A process as defined in claim 2, wherein the temperature of the feedstock is chosen so as to maintain the water content of the support at between 0.1 and 50 percent by weight of the support.

5. A process as defined in claim 1, wherein the temperature of the feedstock is chosen so as to maintain the water content of the support at between 1 and 25 percent by weight of the support.

6. A process as defined in claim 2, wherein the temperature of the feedstock is chosen so as to maintain the water content of the support at between 1 and 25 percent by weight of the support.

7. A process as defined in claim 1, wherein the feedstock to be treated is held at a temperature above 30° C.

8. A process as defined in claim 3, wherein the feedstock to be treated is held at a temperature above 30° C.

9. A process as defined in claim 6, wherein the feedstock to be treated is held at a temperature between 40 and 140° C.

10. A process as defined in claim 1, wherein the temperature of the feedstock is set at a given value that is higher than that which is necessary for solubilizing the water of reaction, and the water content of the support is maintained within said range of values by injecting water into the feedstock.

11. A process as defined in claim 8, wherein the temperature of the feedstock is set at a given value that is higher than that which is necessary for solubilizing the water of reaction, and the water content of the support is maintained within said range of values by injecting water into the feedstock.

12. A process as defined in claim 9, wherein the temperature of the feedstock is set at a given value that is higher than that which is necessary for solubilizing the water of reaction, and the water content of the support is maintained within said range of values by injecting water into the feedstock.

13. A process as defined in claim 8, wherein the feedstock contains from 20 to 300 ppm of mercaptans, and is treated at a temperature between 40° and 120° C.

14. A process as defined in claim 8, wherein the feedstock contains from 300 to 3,000 ppm of mercaptans, and is treated at a temperature between 50° and 140° C.

15. A process as defined in claim 1, wherein the hourly space velocity of the feedstock ranges from 1 to 10 v/v/hr.

16. A process as defined in claim 12, wherein the hourly space velocity of the feedstock ranges from 1 to 10 v/v/hr.

17. A process as defined in claim 1, wherein the metal chelate is selected from the group consisting of the metal phthalocyanines, porphyrins and corrins.

18. A process as defined in claim 8, wherein the metal chelate is selected from the group consisting of the metal phthalocyanines, porphyrins and corrins.

19. A process as defined in claim 16, wherein the metal chelate is selected from the group consisting of the metal phthalocyanines, porphyrins and corrins.

20. A process as defined in claim 8, wherein the support in the fixed bed is selected from the group consisting of the activated charcoals, the aluminas, the clays, the aluminosilicates and the silicates, and mixtures thereof.

21. A process as defined in claim 17, wherein the support in the fixed bed is selected from the group consisting of the activated charcoals, the aluminas, the clays, the aluminosilicates and the silicates, and mixtures thereof.

22. A process as defined in claim 19, wherein the support in the fixed bed is selected from the group consisting of the activated charcoals, the aluminas, the clays, the aluminosilicates and the silicates, and mixtures thereof.

23. A process as defined in claim 8, wherein the regulation of the temperature of the feedstock to be treated is controlled by a system for measuring the difference between the water content of the feedstock upstream of the catalytic oxidation stage and its water content downstream thereof.

24. A process as defined in claim 19, wherein the regulation of the temperature of the feedstock to be treated is controlled by a system for measuring the difference between the water content of the feedstock upstream of the catalytic oxidation stage and its water content downstream thereof.

25. A process as defined in claim 1, wherein the regulation of the temperature of the feedstock to be treated is controlled by a means for measuring the water content of the support in the fixed bed.

26. A process as defined in claim 8, wherein the regulation of the temperature of the feedstock to be treated is controlled by a means for measuring the water content of the support in the fixed bed.

27. A process as defined in claim 19, wherein the regulation of the temperature of the feedstock to be treated is controlled by a means for measuring the water content of the support in the fixed bed.

28. A process as defined in claim 11, wherein the water injection is continuous.

29. A process as defined in claim 11, wherein the water injection is intermittent.

30. A process as defined in claim 8, wherein the feedstock contains from 300 to 3,000 ppm of mercaptans, and is treated at a temperature above 40° C.

* * * * *

UNITED STATES PATENT AND TRADEMARK OFFICE

CERTIFICATE OF CORRECTION

PATENT NO. : 5,069,777

DATED : December 3, 1991

INVENTOR(S) : Orgebin et al.

It is certified that error appears in the above-identified patent and that said Letters Patent is hereby corrected as shown below:

On the Title page, item [30], Priority Data should read --Sept. 8, 1989--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*